United States Patent [19]

Laske et al.

[11] Patent Number: 4,732,705

[45] Date of Patent: Mar. 22, 1988

[54] PROCESS FOR THE IMPROVEMENT OF THE STABILITY PROPERTIES OF SOLIDIFIED RADIOACTIVE ION EXCHANGE RESIN PARTICLES

[75] Inventors: Dietrich Laske, Zurich; Lothar Döhring, Hettenschwil, both of Switzerland

[73] Assignee: Gesellschaft zur Förderung der Industrieorientierten Forschung an den Schweizerischen Hochschulen und Weiteren Institutionen, Bern, Switzerland

[21] Appl. No.: 796,747

[22] Filed: Nov. 12, 1985

[30] Foreign Application Priority Data

Nov. 12, 1984 [CH] Switzerland ..... 5407/84

[51] Int. Cl.[4] ..... G21F 9/16; G21F 9/08

[52] U.S. Cl. ..... 252/628; 252/632; 252/631

[58] Field of Search ..... 252/628, 626, 632, 631; 423/6, 7; 210/682, 683, 684, 685, 686, 687; 106/89, 90; 159/47.3, DIG. 12

[56] References Cited

U.S. PATENT DOCUMENTS

| | | | |
|---|---|---|---|
| 3,334,050 | 8/1967 | Grotenhuis et al. | 252/628 |
| 3,791,981 | 2/1974 | Calmon | 252/632 |
| 4,122,048 | 10/1978 | Buchwalder et al. | 252/628 |
| 4,204,974 | 5/1980 | Puthawala et al. | 252/632 |
| 4,235,738 | 11/1980 | Knotik et al. | 252/628 |
| 4,268,409 | 5/1981 | Ga et al. | 252/632 |
| 4,460,500 | 7/1984 | Hultgren | 252/628 |
| 4,483,789 | 11/1984 | Kunze et al. | 252/628 |
| 4,559,170 | 12/1985 | Gay et al. | 252/626 |

FOREIGN PATENT DOCUMENTS

| | | |
|---|---|---|
| 3102473 | 12/1981 | Fed. Rep. of Germany . |
| 2290745 | 6/1976 | France . |
| 2356246 | 1/1978 | France . |
| 2502382 | 9/1982 | France . |

*Primary Examiner*—Stephen J. Lechert, Jr.
*Assistant Examiner*—Howard J. Locker
*Attorney, Agent, or Firm*—Watson, Cole, Grindle & Watson

[57] ABSTRACT

Before or during their solidification in a matrix, the radioactive ion exchange resin particles, which can be anion and/or cation resins, treated with an additive, which has inorganic or organic anions or cations or organically anion active or cation active components and is chosen in such a manner that the treatment has the effect to reduce the swelling behavior of the resin particles and preferably produces a permanent shrinkage of the resin particles. This change of the resin particles can also be attained or supported by a thermal treatment.

A matrix contains ion exchange resin particles which are treated in such a manner shows an improved water resistance which, contrary to the current state of the art, will also remain assured when the matrix is dried and then again stored in water. In addition, it is possible to accommodate a larger amount of treated resin particles in a volume, as compared to untreated resin particles. In this manner, the disposal and final storage of radioactive ion exchange resins is also made easier.

10 Claims, No Drawings

PROCESS FOR THE IMPROVEMENT OF THE STABILITY PROPERTIES OF SOLIDIFIED RADIOACTIVE ION EXCHANGE RESIN PARTICLES

BACKGROUND OF THE INVENTION

1. Field of the Invention

The current invention concerns a process for the improvement of the stability properties of solidified radioactive ion exchange resin particles, wherein the resin particles are embedded in a mixture containing an inorganic and/or organic binding agent, which is then left to harden.

2. The Prior Art

In most nuclear power plants organic ion exchange resins in the form of beads or powder are used for the cleaning of the various water circulation systems. In the following, the beads as well as the powder particles of the ion exchange resins are designated as resin particles. The ion exchange resin particles act to retain general impurities in the water circulation systems, and also radionuclides. In this manner, the activity of the circulation systems can be kept within limits. Active ion exchange resins also accumulate in the reprocessing plants. The use of ion exchange resins almost always is carried out in mixed bed processes, i.e., mixed anion and cation exchange resins. Only fresh resins in the OH' or H' form are used in each case, so that no foreign ions are introduced into the circulation systems. The ion exchange resins have to be replaced each time when their capacity has been exhausted by charging with general impurities when they can no longer accept any activity. The replaced ion exchange resins are to be considered mildly to medium active radioactive waste which has to be disposed of.

For a final storage, but even for transport, radioactive waste has to be generally solidified, whereby, for security reasons, varying demands are made with regard to the solidified waste. This includes sufficiently high compressive strength, a good water resistance, sulfate resistance and the lowest possible leach rate. For the solidification of radioactive ion exchange resins, the resin particles are embedded into inorganic and/or organic binding agents, such as cement, bitumen or plastics for the formation of a so-called matrix. It is desired to accommodate the greatest possible amount of waste within a certain matrix volume. The swelling and shrinking behavior of organic ion exchange resins is responsible for the fact that the matrix, after solidification, is possibly not water resistant. For this reason the cement solidification for such resins is often regarded with skepticism. In fact, such a matrix may develop cracks during later storage in water, or even decay, if not special techniques are used during solidification.

With regard to the described facts, the amount of resin for the solidification of resin particles has usually been limited to about 20 kg of dry resin particles per 100 liters of matrix, whereby the resulting compressive strength was a little above 20 $N/mm^2$. In addition, if the solidification of the cement mixture takes place under water, the matrix also becomes water resistant, unless it is not dried between. With a higher share of ion exchange resins in the matrix, the compressive strength decreases below 10 $N/mm^2$. But even such a matrix can, under certain circumstances, remain stable at water storage, if there is no drying beforehand. However, if test bodies of such cement solidification procedures are conditioned, e.g., in air with 20% relative humidity, whereby drying causes a weight loss of up to 25%, they are no longer stable for water storage. Their compressive strength decreases already considerably during the drying process, whereby shrinkage tears appear. During subsequent water storage, the test pieces decay in most cases within hours or a few days, or at least large tears appear.

SUMMARY OF THE INVENTION

It is the object of the current invention to create a process by which the stability properties of solidified radioactive ion exchange resin particles is considerably improved and thus also makes it possible to give greater amounts of resin into a matrix volume.

The invention is based on the knowledge that by a suitable treatment of the radioactive ion exchange resin particles before or during the solidification process, the swelling and shrinking properties of the resin particles can be improved in such a manner that the resulting solid matrix can, with approximately the same compressive strength, not only contain a considerably increased amount of ion exchange resin, but also have good water resistance and stability after drying. By the treatment according to the invention, the ion exchange resin particles can be brought into a stable state in which they have, compared to untreated resin particles, a reduced swelling capability and possibly also a smaller volume.

The invention will be now explained in more detail by way of examples, and compared to the state of the art.

Depending on the type of nuclear reactor, two different types of ion exchange resins are used in Switzerland, which are, mainly powder resins such as the Powdex resins from Graver Water Conditioning Co., U.S.A in boiling water reactors, and almost exclusively bead resins such as the Lewatit resins from Bayer/Leverkusen, FRG in pressurized water reactors. The following examples are based on tests with bead resins of the last mentioned type. However, the results with powder resins are almost the same. Used as anion exchange resin was the type Lewatit M-500 and as cation exchange resin the type Lewatit S-100, both from Bayer/Leverkusen, FRG. The radioactive ion exchange resins taken from the water circulation systems of a nuclear power plant were, in addition, charged as follows: anion exchange resin M-500 with approx. 200 g of boric acid ($H_3BO_3$) per liter resin; cation exchange resin S-100 with 4 g lithim per liter resin.

By treating the anion resin particles with a polysulfide it was surprisingly possible to induce the resin particles to strong shrinkage with simultaneous water expulsion. After drying at room temperature and subsequent washing of the thus treated resin particles, they showed a swelling factor of only 1.5 as compared to 2.0 before the treatment. The swelling factor is here defined as the quotient from the settled volume of the resin particles in water-moistened swollen state and the settled volume of the same resin particles in dry state.

When, after the polysulfide treatment, the anion resin particles were treated for about 24 hours at a temperature of 50° C., the swelling factor even dropped to near 1.0, which means that the resin particles then do not swell anymore at all and shrink during washing and drying.

If, during the treatment with polysulfide, a vulcanization agent, e.g. a xanthate, was also added to the anion resin particles, the swelling factor dropped to between 1.0 and 1.1, even at room temperature.

It was possible, not only by treatment with polysulfides, to greatly reduce the swelling factors of anion resin particles, but also by ion exchange with special organic acids or anion-active organic compounds. Named as such can be mono and polyfunctional carboxylic acids, their salts and their derivatives, such as stearic acid, acrylic acid, natural and modified root resins, sebacic acid, etc.; sulfuric acid mono-esters, such as lauryl sulfate; sulfonates, such as vinyl-sulfonate; phosphoric acid mono and di-esters, such as stearic phosphates, butyl phosphates, nonyl phosphates. These substances block the hydrophilic groups of the anion resins and can, in part, still be cross-linked.

For the anion resin, a thermolysis process also proved as suitable as the treatment by addition of polysulfide or of another of the above cited compounds. The splitting off of amines from anion resins at higher temperatures is generally known. The producers of resins issue clear warnings against too high temperatures, as those would endanger the ion exchange properties. However, it has now been discovered that this so far undesirable phenomenon can be used for the improvement of the stability properties of solidified radioactive ion exchange resin particles. If anion resin particles are heated for extended time to 150° C., preferably in an air stream while stirring, amines are split off, primarily trimethylamine. With such a process, the resin particles shrink strongly and lose their swelling and shrinking properties. By adding alkali or earth alkali hydroxides, the decomposition temperature can even be slightly lowered. The duration of the thermal treatment depends on the treatment temperature. The higher the temperature, the shorter the treatment time can be. The temperature for thermolysis can be chosen in the range from between 50° C. and 250° C., preferably between 100° C. and 200° C., whereby the duration of treatment can be, e.g., in the range of between 24 hours and down to ½ hour.

It is also possible to split off amines from anion resin particles which have previously been treated with sulfides or polysulfides by an additional heat treatment within the limits as described above. Surprisingly, this is already possible successfully at a temperature below 100° C., e.g., between 70° and 80° C. This low decomposition temperature affords essential technical advantages, especially for the gas purification. By a subsequent oxidation with $H_2O_2$ it is possible to produce from the original anion resins even cation-active resins, which can disintegrate oxidatively more easily.

It was possible to equally strongly reduce the swelling and shrinking properties of cation resin particles with very specific cation or cation active compounds as that of anion resin particles. This was done by the addition of substances from the following groups: primary, secondary, tertiary or quartenary basic amines which have, per molecule, either one, two or more amine groups, whereby the organic groups can be additionally cross-linked; basic organic phosphonium compounds; basic organic sulphonium compounds. A similar effect is shown by $Ba^{++}$ and $Fe^{++}$ salts. These ionogenic compounds, which sterically fit into the ion exchange resins, are, in part, so tightly bound to the resins that, in the solution of a cement mixture or in highly mineralized ground waters, they no longer exchange these ions and thus the resins remain stable as to volume. This adhesion could often be still improved by a subsequent heat treatment, whereby the swelling factor was still further reduced.

In practice, mixtures of anion and cation resin particles are used in most cases. In order to attain, simultaneously, a reduction of the swelling factor for both types of resin particles, one of the described treatments for the anion resin particles as well a one of the described treatments for the cation particles is to be used, or a compoud should be added to the mixture of anion and cation resin particles which contains anion as well as cation active components, and thus effective anions and cations or anion active as well as cation active components. The volume ratios and the swelling factors of the thus treated mixtures of anion and cation resins are composed proportional to the mixture ratio from the data of the individual components, and can thus be precalculted for mixtures when the data of the individual components are known.

A series of tests was done with each of the cation resin particles of the type Lewatit S-100 and anion resin particles of the type Lewatit M-500 as well as with a mixture of 50% by weight of Lewatit S-100 and 50% by weight of Lewatit M-500, in order to determine the comparative volumes of the resin particles in water-moistened, swelled state and in dry state, as well as the swelling factor, which was done for resin particles without treatment and for resin particles after one of the treatments described above. The results obtained are displayed in table I.

The comparative volumes cited in table I (liter/kg) are, in each case, the specific settled volume in liters of an amount of 1 kg dried ion exchange resin particles in the H or OH form, whereby the specific settled volume is cited once for the wet, swelled resin particles and once for the dry resin particles. The swelling factor is the quotient of wet volume over dry volume.

The original state of the resin particles always was the H or OH form. The resin particles were treated with solutions which contained only the substances stated in table I. The amounts of the treatment solution were usually sufficient that a complete charging of the resins according to their maximum capacity was made possible. Where nothing else is stated, the resin particles were treated, in each case, for ½ hour at 50° C. with the stated solution, then cooled to 20° C., and stirring continued for another ½ hour at 20° C., before filtering and washing the resin particles with distilled water. To determine the specific settled volume of the dried resin particles, the latter were dried in a vacuum at 40° C. until their water content was less than 1% by weight.

Where a heat treatment at 160° C. is mentioned in table I, this refers to a drying and subsequent heating to 160° C. for 2 hours.

The values cited in table I under nos. 1 to 3 refer to untreated ion exchange resins. The tests no. 4 to 61 were done with cation resin particles and the test no. 62 to 83 with anion resin particles. The information under no. 84 to 103 refer to tests with a mixture of 50% by weight of cation and 50% by weight of anion resin particles.

It can be seen from table I that the untreated ion exchange resin particles have a swelling factor between 2.1 and 2.24 at a specific settled volume in a wet, swollen state of 2.5 to 3.23 liter per kg dry substance. Table I shows also that the swelling factor can be substantially reduced to or nearly to 1.0 by a suitable treatment of the resin particles. Of interest in practice are all those types of treatment which result in a swelling factor of less than 1.7. However, also of importance are the statements in table I concerning the wet volume of the treated resin particles. The smaller the wet volume, the greater is the amount of resin particles which can be solidified in a given volume. Thus, a type of treatment should preferably be used which provides an optimum between the lowest possible swelling factor and, simultaneously, the smallest specific wet volume. In order to determine the effect of the reduction of the swelling factor on the stability properties of solidified radioactive ion exchange resin particles, the comparison tests, described below, were executed, on the one hand, on a known standard cement solidification of untreated resin particles and, on the other hand, of a cement solidification for the reduction of the swelling factor of treated resin particles.

Used as base was in both cases a mixture of 50% by weight of cation exchange resin of the type Lewatit S-100 and 50% by weight of anion exchange resin of the type Lewatit M-500, as it is obtained, e.g., from the Swiss nuclear power plant Goesgen as radioactive waste.

(a) Cement Solidification of Untreated Resin Particles 60 parts by weight of the untreated resin particle mixture with 50% water content, i.e. fully swelled, were mixed with

- 100 parts by weight of synthetic Portland cement with high silicate content, designation CPA 55 HTS, produced by Ciments Lafarge France, F-92214 St. Cloud (corresponding to the French norm NF P 15301, December 1978, and the American norm ASTM as type V, quality "low alkali cement"),
- 40 parts by weight of hydraulic Nettetal trass according to DIN 51043, produced by Trass-Werke Meurin, Andernach/Rhine, FRG, Kruft plant,
- 10 parts by weight of calcium hydroxide, $Ca(OH)_2$
- 4.2 parts by weight of super liquified (naphthaline-formaldehyde condensate), designation Sikament, produced by Sika AG, CH-8048 Zurich, and
- 30.8 parts by weight of water.

The mixture according to the above prescription was left to harden with a water coating. The thus resulting solid matrix provided the values as shown in table II.

(b) Pretreatment of the Resin Particles 63.65 parts by weight of the resin particle mixture with 16.4% by weight water content (solid matter dry 83.6% by weight) were mixed to a thin gruel with the following additives:

- 36.0 parts by weight of $BaS_4$ solution with 72.4% by weight water content (solid matter dry 27.6% by weight) and
- 43.35 parts by weight of $Ba(OH)_2.8H_2O$.

Thereby the cation resin was charged with $Ba^{++}$ and the anion resin with $S_4^{--}$. The borate which was split off from the anion resin was precipitated with more $Ba^{++}$ as insoluble barium-metaborate. This reaction, resulting from the mixing, caused heat to be released, which had the effect that the mixture heated itself from room temperature to about 50° C. Then, the mixture was kept for several hours at 50° C. The cement solidification took place about 24 hours after the described pretreatment. In the meantime, the mixture was stirred further, in order to prevent a settling of the solid matter and the formation of larger crystals. A water loss by evaporation during this time was compensated for by more water. The thus pretreated resin particles provided the values cited in table I under no. 89.

(c) Cement Solidification of the Pretreated Resin Particles

A previously prepared mixture, consisting of

- 100 parts by weight of synthetic Portland cement of the same quality as described in section (a), and
- 40 parts by weight of hydraulic Nettetal trass of the same quality as described in section (a)

was added to the mixture described in section (b) with the pretreated ion exchange resin particles.

At the beginning, only enough of the above mixture was added and homogenically stirred in until there was a thick gruel which ran together by itself. Then followed the addition of

- 2.5 parts by weight of cement additive for improving the cement density and solidity, designation Sperrbarra Plus OL, supplied by Meynadier & Cie AG, CH-8048 Zurich.

With the addition of this cement additive, the gruel became obviously more liquid. It was then possible to add the remaining Portland cement/trass mixture with constant stirring. The final gruel had a just pumpable consistency and was homogenically mixed for another 10 minutes. The mixed in air bubbles were removed by vibration. After about 2 hours, the mixture was gelled sufficiently thixotrope so that it could be coated with water for hardening. The hardening by setting of the cement started after 5 to 6 hours, which could be recognized by a rise in temperature. The finally resulting matrix showed the values as listed in table II.

(d) Comparison of the Properties of the Hardened Matrix with Untreated or Treated Ion Exchange Resin Particles Compared in table II are the corresponding values of the hardened matrix produced according to section (a) (state of the art) and the matrix produced according to sections (b) and (c).

It can be clearly seen from table II that by the described pretreatment of the ion exchange resin particles, according to the invention, for reduction of the swelling factor has two essential advantages as compared to the state of the art. The main advantage can be seen in the fact that the water resistance of the hardened matrix is guaranteed, even when the matrix is dried to a weight constant at 20% relative humidity and is then stored again in water, whereby the water resistance in the matrix according to the state of the art is only guaranteed as long as there is no intermediate drying. The other advantage is that at a given matrix volume, e.g. 100 liter, a considerably greater amount of resin particles, 35.1 kg as compared to 22 kg dry substance of the original resin particles can be enclosed. This can effectively ease the disposal and final storage for radioactive waste ion exchange resins. It has to be stated as another advantage of the new process that the other properties of the solid matrix, especially the compressive strength and sulfate resistance, are not impaired by the pretreatment of the ion exchange resin particles according to the invention.

It is clear that for the pretreatment of the ion exchange resin particles to be solidified it is possible to use a large number of other substances besides those listed in table I and that the prescription stated as example for the cement solidification can be modified. The ion exchange resin particles with reduced swelling factor, pretreated according to the invention, are not only suitable for cement solidification, but can be solidified also, with equally good results, using bitumen or plastics.

TABLE I

| No. | Lewatit (%) S 100 | Lewatit (%) M 500 | treated with: | comp. vol. wet (l/kg) | comp. vol. dry (l/kg) | swell factor |
|---|---|---|---|---|---|---|
| 1 | 100 | — | none | 2.50 | 1.19 | 2.10 |
| 2 | — | 100 | none | 3.23 | 1.44 | 2.24 |
| 3 | 50 | 50 | none | 2.86 | 1.28 | 2.23 |
| 4 | 100 | — | cocosamine acetate | 2.61 | 1.89 | 1.38 |
| 5 | 100 | — | dibutylamine | 2.59 | 2.28 | 1.14 |
| 6 | 100 | — | tributylamine | 2.67 | 2.28 | 1.17 |
| 7 | 100 | — | dibutylamine nitrate | 2.42 | 1.94 | 1.25 |
| 8 | 100 | — | tributylamine nitrate | 2.51 | 2.04 | 1.23 |
| 9 | 100 | — | vinyl imidazole | 2.56 | 1.79 | 1.43 |
| 10 | 100 | — | vinyl imidazole nitrate | 2.44 | 1.51 | 1.62 |
| 11 | 100 | — | benzylcocodimethyl-ammonium chloride | 2.60 | 1.45 | 1.79 |
| 12 | 100 | — | suetalkyltrimethyl-ammonium chloride | 2.73 | 1.56 | 1.75 |
| 13 | 100 | — | disuetalkyldimethyl-ammonium chloride | 2.68 | 1.45 | 1.85 |
| 14 | 100 | — | dioctyldimethylammonium chloride | 2.57 | 1.79 | 1.44 |
| 15 | 100 | — | didecyldimethylammonium chloride | 2.61 | 1.66 | 1.57 |
| 16 | 100 | — | tetraethylammonium hydroxide | 3.08 | 2.32 | 1.33 |
| 17 | 100 | — | tetrapropylammonium hydroxide | 3.01 | 2.43 | 1.24 |
| 18 | 100 | — | tetrabutylammonium hydroxide | 2.85 | 2.48 | 1.15 |
| 19 | 100 | — | tributylmethylammonium hydroxide | 3.08 | 2.75 | 1.12 |
| 20 | 100 | — | benzyltrimethylammonium hydroxide | 2.73 | 2.23 | 1.22 |
| 21 | 100 | — | trimethylammoniumethyl-methacrylate metho-sulfate | 2.53 | 1.59 | 1.59 |
| 22 | 100 | — | as in 21 then polymerized with ammonium peroxi-disulfate | 2.40 | 1.84 | 1.30 |
| 23 | 100 | — | ethylenediamine | 2.35 | 1.42 | 1.65 |
| 24 | 100 | — | ethylenediamine carbonate | 2.30 | 1.37 | 1.68 |
| 25 | 100 | — | 1,2 propylenediamine | 2.46 | 1.57 | 1.57 |
| 26 | 100 | — | 1,2 propylenediamine carbonate | 2.54 | 1.58 | 1.61 |
| 27 | 100 | — | 1,4 phenylenediamine | 2.34 | 1.94 | 1.21 |
| 28 | 100 | — | 1,4 phenylenediamine carbonate | 2.43 | 1.86 | 1.31 |
| 29 | 100 | — | piperazine | 2.52 | 1.59 | 1.58 |
| 30 | 100 | — | piperazinecarbonate | 2.70 | 1.70 | 1.59 |
| 31 | 100 | — | semicarbazide hydro-chloride | 2.19 | 1.27 | 1.72 |
| 32 | 100 | — | guanidine carbonate | 2.28 | 1.65 | 1.38 |
| 33 | 100 | — | aminoguanidine carbonate | 2.25 | 1.57 | 1.43 |
| 34 | 100 | — | S—methylisothiourea hydroxide | 2.11 | 1.66 | 1.27 |
| 35 | 100 | — | S—benzylisothiourea hydroxide | 2.20 | 1.88 | 1.17 |
| 36 | 100 | — | acethydrazide-trimethyl ammonium chloride | 2.24 | 1.37 | 1.64 |
| 37 | 100 | — | pentane-1,5-bi-trimethyl ammonium iodite | 1.81 | 1.21 | 1.50 |
| 38 | 100 | — | decane-1,10-bi-trimethyl ammonium iodite | 2.01 | 1.43 | 1.41 |
| 39 | 100 | — | hydrazine hydrate | 2.26 | 1.27 | 1.78 |
| 40 | 100 | — | heptamethylguanidine hydroxide | 2.50 | 1.78 | 1.40 |
| 41 | 100 | — | propane-1,3-bi-trimethyl ammonium hydroxide | 2.10 | 1.45 | 1.45 |
| 42 | 100 | — | tetrabutylphosphonium hydroxide | 2.58 | 2.20 | 1.17 |
| 43 | 100 | — | methyltriphenylphospho-nium hydroxide | 2.32 | 1.76 | 1.32 |
| 44 | 100 | — | trimethylsulphonium hydroxide | 2.51 | 1.60 | 1.57 |
| 45 | 100 | — | thallium nitrate | 2.09 | 1.19 | 1.76 |

TABLE I-continued

| No. | Lewatit (%) S 100 | Lewatit (%) M 500 | treated with: | comp. vol. wet | comp. vol. dry | swell factor |
|---|---|---|---|---|---|---|
| 46 | 100 | — | magnesium chloride | 2.40 | 1.19 | 2.02 |
| 47 | 100 | — | calcium chloride | 2.36 | 1.20 | 1.97 |
| 48 | 100 | — | barium chloride | 2.06 | 1.21 | 1.70 |
| 49 | 100 | — | barium hydroxide | 2.05 | 1.31 | 1.56 |
| 50 | 100 | — | cadmium chloride | 2.45 | 1.27 | 1.93 |
| 51 | 100 | — | copper chloride | 2.47 | 1.20 | 2.06 |
| 52 | 100 | — | manganese-2-chloride | 2.40 | 1.30 | 1.85 |
| 53 | 100 | — | cobalt chloride | 2.48 | 1.23 | 2.02 |
| 54 | 100 | — | nickel chloride | 2.49 | 1.27 | 1.96 |
| 55 | 100 | — | iron-3-chloride | 2.44 | 1.16 | 2.10 |
| | | | | (1 kg) | | |
| 56 | 100 | — | iron-2-sulfate | 2.21 | 1.37 | 1.61 |
| 57 | 100 | — | chromium chloride | 2.59 | 1.28 | 2.02 |
| 58 | 100 | — | aluminum chloride | 2.45 | 1.24 | 1.98 |
| 59 | 100 | — | titanium-3-chloride | 2.57 | 1.28 | 2.01 |
| 60 | 100 | — | zinc acetate | 2.55 | 1.18 | 2.16 |
| 61 | 100 | — | tin chloride | 2.38 | 1.17 | 2.03 |
| 62 | — | 100 | ammonium stearate | 3.23 | 2.53 | 1.28 |
| 63 | — | 100 | acrylic acid | 2.89 | 1.73 | 1.67 |
| 64 | — | 100 | dimethylacrylic acid | 2.86 | 1.73 | 1.65 |
| 65 | — | 100 | diammonium sebacate | 2.80 | 1.69 | 1.66 |
| 66 | — | 100 | sylvatac 140, dimerized liquid rosin, SZ 134, (Sylvachem Corp., USA) $H_2O$ soluble w/10% NaOH | 1.98 | 1.44 | 1.38 |
| 67 | — | 100 | resin B 106, colophonium pentester SZ 204 (Hercules Inc. USA) $H_2O$ soluble w/ 6.25% $NH_3$ | 2.68 | 1.80 | 1.49 |
| 68 | — | 100 | Vinsol resin, pine root resin SZ 95 (Hercules Inc. USA) $H_2O$ soluble w/7% NaOH | 2.72 | 1.80 | 1.51 |
| 69 | — | 100 | ammonium lauryl sulfate | 2.84 | 1.74 | 1.63 |
| 70 | — | 100 | vinylpentasulphonate-Na | 2.83 | 1.78 | 1.59 |
| 71 | — | 100 | monobutylphosphoric acid ester | 2.88 | 1.83 | 1.57 |
| | | | | (l/kg) | | |
| 72 | — | 100 | mono and dibutylphosphoric acid ester, 50% each | 2.98 | 2.08 | 1.43 |
| 73 | — | 100 | monostearylphosphoric acid ester | 4.09 | 3.25 | 1.26 |
| 74 | — | 100 | mono + di-nonyletraethoxi-phenolphosphoric acid ester | 3.30 | 2.57 | 1.28 |
| 75 | — | 100 | potassium polysulfide at 20° C. | 2.61 | 1.57 | 1.66 |
| 76 | — | 100 | potassium polysulfide at 50° C. | 2.49 | 1.51 | 1.65 |
| 77 | — | 100 | calcium polysulfide at 20° C. | 2.14 | 1.53 | 1.40 |
| 78 | — | 100 | calcium polysulfide at 50° C. | 1.55 | 1.51 | 1.03 |
| 79 | — | 100 | as 77 + 10% potassium ethylxanthogenate (rel. to resin dry) | 1.75 | 1.70 | 1.03 |
| 80 | — | 100 | barium polysulfide at 20° C. | 2.11 | 1.69 | 1.25 |
| 81 | — | 100 | barium polysulfide at 50° C. | 1.77 | 1.71 | 1.04 |
| 82 | — | 100 | as 80 + 10% potassium ethylxanthogenate (rel. to resin dry) | 2.11 | 1.83 | 1.15 |
| 83 | — | 100 | complete thermolysis at 150° C. in air stream | 1.01 | 1.01 | 1.00 |
| 84 | 50 | 50 | as 83 | 1.80 | 1.10 | 1.64 |
| 85 | 50 | 50 | tetrabutylammonium hydroxide then thermolysis at 160° C. in air stream | 1.94 | 1.86 | 1.04 |
| 86 | 50 | 50 | guanidine carbonate, then thermolysis at 160° C. in air stream | 1.57 | 1.28 | 1.23 |
| 87 | 50 | 50 | aminoguanidinehydrogen carbonate, then thermo-lysis at 160° C. in air stream | 1.57 | 1.31 | 1.20 |
| 88 | 50 | 50 | tetrabutylammonium hydrox-ide, then calcium poly-sulfide | 2.14 | 1.89 | 1.13 |
| 89 | 50 | 50 | barium polysulfide a/50° C. | 1.91 | 1.51 | 1.26 |

TABLE I-continued

| No. | Lewatit (%) S 100 | Lewatit (%) M 500 | treated with: | comp. vol. wet | comp. vol. dry | swell factor |
|---|---|---|---|---|---|---|
| 90 | 50 | 50 | as 89 + 10% K—ethyl-xanthogenate a/20° C. | 2.08 | 1.57 | 1.32 |
| 91 | 50 | 50 | ethylenediamine polysulfide | 1.90 | 1.44 | 1.32 |
| 92 | 50 | 50 | as 91 + heat treatment at 160° C. | 1.62 | 1.38 | 1.17 |
| 93 | 50 | 50 | propylenediamine poly-sulfide | 1.80 | 1.38 | 1.30 |
| 94 | 50 | 50 | as 93 + heat treatment at 160° C. | 1.57 | 1.36 | 1.15 |
| 95 | 50 | 50 | piperazine polysulfide | 1.96 | 1.39 | 1.41 |
| 96 | 50 | 50 | as 95 + heat treatment 160° C. | 1.62 | 1.37 | 1.18 |
| 97 | 50 | 50 | guanidine polysulfide | 1.93 | 1.51 | 1.28 |
| 98 | 50 | 50 | as 97 + heat treatment 160° C. | 1.57 | 1.33 | 1.18 |
| 99 | 50 | 50 | aminoguanidine poly-sulfide | 1.98 | 1.57 | 1.26 |
| 100 | 50 | 50 | as 99 + heat treatment 160° C. | 1.75 | 1.45 | 1.21 |
| 101 | 50 | 50 | tetramethylguanidine polysulfide | 1.97 | 1.47 | 1.34 |
| 102 | 50 | 50 | as 101 + heat treatment 160° C. | 1.67 | 1.59 | 1.05 |
| 103 | 50 | 50 | dicyandiamide + heat treatment 160° C. | 1.89 | 1.55 | 1.22 |

TABLE II

| Properties of matrix | Cement solidification of untreated ion exchange resin particles | Cement solidification of pretreated ion exchange resin particles |
|---|---|---|
| volume weight | 1.8 t/m$^3$ (water content acc.to recipe) | 1.8 t/m$^3$ (water content acc.to recipe) |
| resin content | 22 kg dry substance in 100 liter matrix | 35.1 kg dry substance without treatment, in 100 liter matrix |
| compressive strength (acc. SIA 215) | 22 N/mm$^2$ after more than 20 weeks of hardening | 21 N/mm$^2$ after more than 20 weeks of hardening |
| sulfate resist. | is assured | is assured |
| water resistance | is assured as long as the matrix has not been dried before wetting | is assured even when the matrix has been dried before wetting |
| leach rates RL 730 | in distilled water: $10^{-4}$ to $10^{-5}$ for Cs-137 $10^{-6}$ to $10^{-7}$ for Co-60 $10^{-3}$ to $10^{-4}$ for Sr-90 (in water saturated with gypsum, smaller by 1 or 2 orders of magnitude) | values not yet obtained Based on recipe about the same results are expected. |

We claim:

1. In a method of packaging radioactive anion and/or cation exchange resin particles for shipment or storage wherein the resin particles are added to a cement mixture so as to form a cement matrix and the cement matrix is then allowed to solidify, the improvement comprising adding a chemically affecting additive to said resin particles and/or heating said resin particles prior to or during the solidification of said cement matrix to reduce their swelling factor to below 1.7, said swelling factor representing the quotient of the settled volume of said resin particles in a water-moistened, swelled state and the settled volume of said resin particles in a dry state, thus reducing the swelling and shrinking properties of said resin particles to such an extent that an increased amount of said resin particles can be added to said cement mixture per unit volume without reducing the water resistance of the solidified cement matrix to an unacceptable level.

2. A method according to claim 1, wherein said improvement comprises adding a chemically affecting additive to said resin particles.

3. A method according to claim 2, wherein said chemically affecting additive treats anion resin particles and consists of inorganic or organic anions or organic anion-active compounds.

4. A method according to claim 2, wherein said chemically affecting additive treats cation resin particles and consists of inorganic or organic cations or organic cation-active compounds.

5. A method according to claim 2, wherein said chemically affecting additive treats both anion and cation resin particles and is a compound which includes both anions and cations.

6. A method according to claim 2, wherein said chemically affecting additive contains organic or inorganic groups which can be cross linked with each other or with at least a portion of said resin particles.

7. A method according to claim 2, wherein said chemically affecting additive is selected from the group consisting of inorganic and organic mono and polysulfides, mono and polyfunctional carboxylic acids, their salts and their derivatives, sulphuric acid monoester, sulphonates and phosphoric acid mono and diesters.

8. A method according to claim 2, wherein said chemically affecting additive is selected from the group consisting of primary, secondary, tertiary and quartenary basic amines, which may also contain two or more amino groups, basic organic phosphonium compounds, basic organic sulphonium compounds, barium++ and iron++ compounds.

9. A method according to claim 1, wherein the improvement comprises heating said resin particles to between 50° C. and 250° C.

10. A method according to claim 9, including the step of passing a gas around said heated resin particles in order to remove volatile decay products emanating therefrom.

* * * * *